US006648067B1

(12) United States Patent
Maute

(10) Patent No.: US 6,648,067 B1
(45) Date of Patent: Nov. 18, 2003

(54) HEAT EXCHANGER FOR CONDENSATION LAUNDRY DRYER

(75) Inventor: Alexander Maute, Hechingen/Stetten (DE)

(73) Assignee: Joma-Polytec Kunststofftechnik GmbH, Bodelshausen (DE)

( * ) Notice: Subject to any disclaimer, the term of this patent is extended or adjusted under 35 U.S.C. 154(b) by 0 days.

(21) Appl. No.: 09/559,173

(22) Filed: Apr. 27, 2000

(30) Foreign Application Priority Data

Nov. 17, 1999 (DE) ..... 299 20 218 U
Dec. 2, 1999 (DE) ..... 199 58 106

(51) Int. Cl.[7] ..... F28D 9/02
(52) U.S. Cl. ..... 165/166; 165/905
(58) Field of Search ..... 165/148, 166, 165/901, 905, 165; 34/86

(56) References Cited

U.S. PATENT DOCUMENTS 2,526,157 A * 10/1950 Ramen ..... 165/162
2,941,787 A * 6/1960 Ramen ..... 165/157
3,757,856 A * 9/1973 Kun ..... 165/148
3,931,854 A * 1/1976 Ivakhnenko et al. ..... 165/166
4,095,349 A * 6/1978 Parker ..... 165/166
4,805,695 A * 2/1989 Ishikawa et al. ..... 165/166
5,944,094 A * 8/1999 Kinney et al. ..... 165/166

FOREIGN PATENT DOCUMENTS

DE 198 38 525 3/1999

* cited by examiner

*Primary Examiner*—Allen Flanigan
(74) *Attorney, Agent, or Firm*—Birch, Stewart, Kolasch & Birch, LLP

(57) ABSTRACT

The invention involves a countercurrent heat exchanger for condensation laundry dryers of the type that is the object of DE 198 38 525 A1.

In order to increase the cooling output of the heat exchanger plates (12) stacked into a heat exchanger plate stack (10), which each contain at least one humid air channel (14) and are made out of thermoplastic plastic or from a film consisting of a heat-conducting metal, the heat exchanger plates (12) are equipped with several struts (32) that form cooling lamellas which project outward from them and extend perpendicularly to the humid air channel (14), and which form pockets that open into the humid air channel (14).

22 Claims, 10 Drawing Sheets

HEAT EXCHANGER FOR CONDENSATION LAUNDRY DRYER

BACKGROUND OF THE INVENTION

1. Field of the Invention

The invention involves a heat exchanger for condensation laundry dryers.

2. Description of the Background Art

A heat exchanger for condensation laundry dryers is known from DE 198 38 525 A1. The construction is characterized by small material requirements in spite of a small film thickness of the heat exchanger plates, by a large degree of rigidity obtained by the struts or the spacers, and by a good heat elimination on the cooling air side.

SUMMARY OF THE INVENTION

The invention involves a further construction of this type of heat exchanger such that in a dimensioning of the stack of plates corresponding to the dimensions of the stack of plates of the known heat exchanger, an increase can be obtained, or, in spite of smaller dimensions of the stack of plates, an adequate or equivalent cooling output can be obtained.

In a heat exchanger of the invention, in which the humid air channel goes through the heat exchanger plates, the struts can be provided on one or on both sides of the heat exchanger plates, depending on whether the heat exchanger plates are to be oriented in the horizontal or vertical position.

In the vertical installation position, no condensate can collect in the struts when the struts are arranged on both sides, so that the strut wall portions of the pocket-like cooling lamella form cooling surfaces which ensure an intensive heat elimination.

In the horizontal installation position, the struts are provided oil the other hand, merely on the upper side of the plates, so that they remain free from condensate.

In another construction, in which the heat exchanger plates have the cooling air channel passing through them, the spacers provided on a plate portion form, on the other hand, pocket-like molded projections, which are open into a humid air channel located between the heat exchanger plates. They thus form at the same time cooling surfaces, which ensure effective heat elimination. Also in this case, both in the horizontal and in the vertical installation position, the pocket-like projections stay free from condensate.

For both heat exchanger constructions, the struts or spacers thus cause at the same time, along with a corresponding increase of the channel surfaces to be brushed over with cooling air, an effective air swirl.

The degree of effectiveness of the heat exchanger can be further improved considerably in that the humid air channel is constructed as a flat tube such that its pocket-like struts in a horizontal arrangement of heat exchanger plates functionally are merely molded onto the upper tube flat side. In this case, the lower plate side of a heat exchanger plate then rests on the struts projecting upwards from the heat exchanger plate lying beneath it, so that in spite of the lack of struts projecting downwards on the lower side of the plate between heat exchanger plates, cooling air channels are present and thus the prerequisites for an intensive heat elimination are created.

The length of the struts extending perpendicularly to the humid air channel can correspond approximately to the width of the humid air channel constructed as a flat-tube. However, a strut length, which merely corresponds to a fraction of the width of the flat tube is preferred, such that the struts are provided in the longitudinal direction of the flat tube functionally offset from each other by gaps.

In an additional embodiment of this heat exchanger construction, it can be advantageous to provide the struts directed at an angle to the blower stream direction of the cooling air at least over a range of the flat tube wall portion, and possibly in certain areas even compacted or in a symmetrical angled arrangement with each other over the entire flat tube wall portion.

By these measures, an optimal flow deflection and distribution, or optimal impingement of the cooling surface, can be obtained for the cooling air in the heat exchanger as a function of the given installation ratios in the condensation laundry dryers, where the flow ratios can be further improved in the cooling air channels by a slightly convex curvature of the strut longitudinal sides perpendicular to the flow direction of the humid air.

A reduced dimensioning of the heat exchanger plates with an equivalent cooling output is thus possible, as long as the upper and lower channel wall portion of the humid air channel are constructed corrugated perpendicularly to the flow direction of the humid air, and the wave curves of both tube wall portions preferably run parallel to each other.

The same effect can likewise be obtained in heat exchangers in the alternate embodiment, provided the upper and lower plate parts of its heat exchanger plates are constructed so that they are corrugated in parallel to each other in the flow direction of the cooling air, and in the process, the depth of the corrugation trough functionally corresponds to approximately half of the mutual separation distance of both plate parts.

In order to manufacture the heat exchanger plates or the films of the heat exchangers that form the heat exchanger plates, different materials are suitable, such as plastic or aluminum, as well as different manufacturing processes. If plastic film is used to manufacture the plates, then it is to be molded thermally, for example, so that two halves result, which each form a plate part independently from each other, and which are made to overlap with each other, and then are fused, adhered, or pressure-attached to each other to be air-tight on the opposite longitudinal sides.

In like manner, it is possible to make the plastic films that form the two plate parts out of one piece and to make the two plate parts overlap with each other by folds of the plastic film and then merely bond them together along the two longitudinal edge portions that cover each other by fusing, adhering, or pressure-attaching.

Finally a preferred manufacturing method can include forming heat exchanger plates in a blow molding tool from an extruded plastic tube.

In order to manufacture the plate parts out of plastic, acrylonitrile-utadiene-styrene copolymers (ABS) or polypropylene are especially suitable, where in order to obtain the desired cooling outputs or the heat capacity and stability required for this, a film thickness of between 0.15 mm and 0.50 mm, preferably 0.30 mm, has proven to be advantageous.

In the case of the use of aluminum film to manufacture the plate parts or the heat exchanger plates, a film thickness is recommended of between 0.14 mill and 0.20 mm, preferably 0.15 mm, where the plate parts made out of aluminum film are to be connected together in an air-tight manner along the two edge parts lying across from each other by mutually fusing, adhering, or pressure-attaching them together.

BRIEF DESCRIPTION OF THE DRAWINGS

The drawings show preferred embodiment examples of the invention, where the heat exchanger plates of the heat exchanger plate stacks are made out of plastic film, and wherein.

DETAILED DESCRIPTION OF THE PREFERRED EMBODIMENTS

Figure 1:
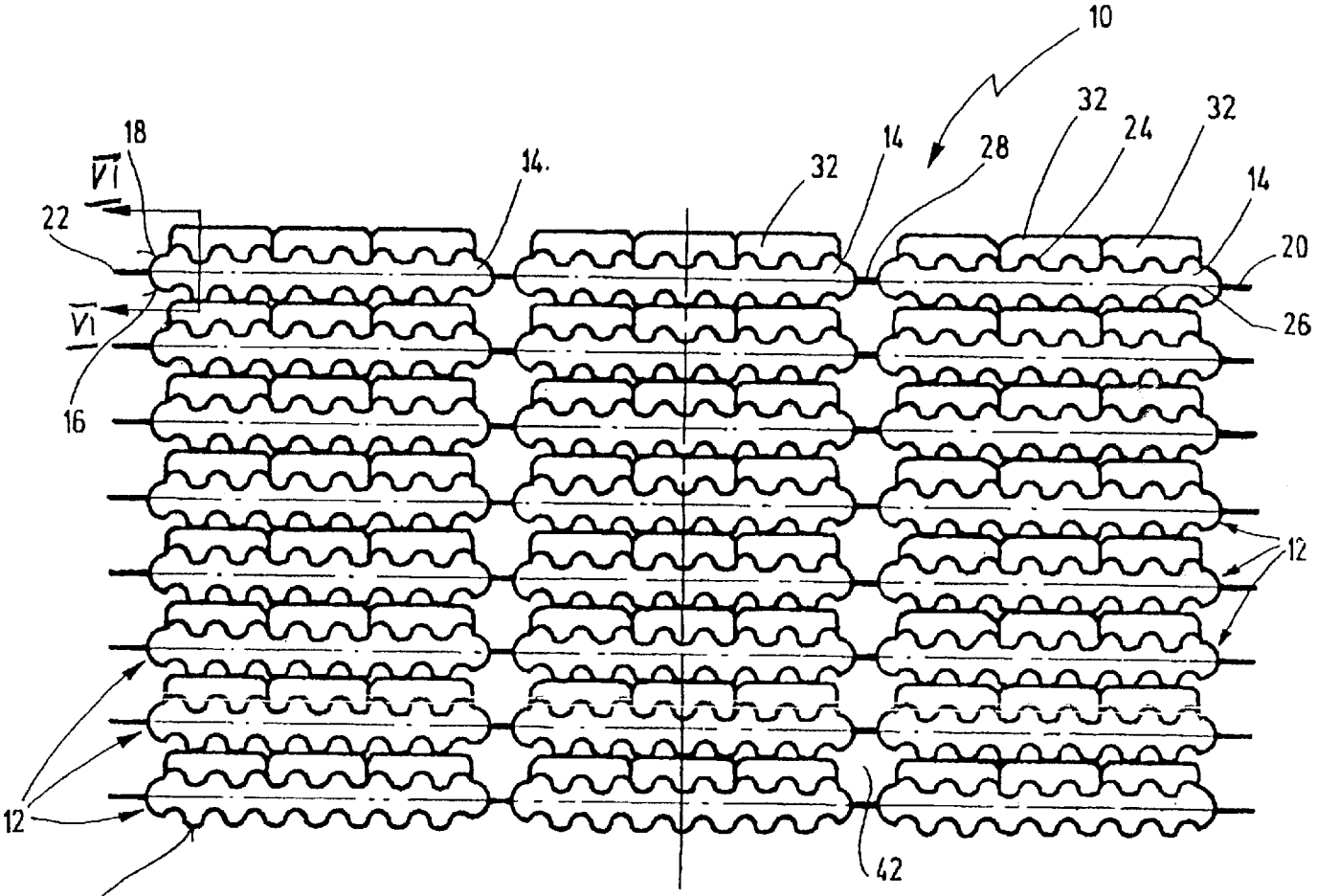
FIG. 1 is a front view of a heat exchanger plate stack for a heat exchanger according to a first embodiment example.

The plate stack 10 shown in FIG. 1 for a heat exchanger for condensation laundry dryers is, for example, made out of eight individual heat exchanger plates that are stacked on top of each other horizontally, for example, and indicated on the whole by 12.

These heat exchanger plates 12 each have, for example, three humid air channels 14 that are running in parallel to each other, which define flat tubes. Each heat exchanger plate 12 comprises a lower plate part 16 (FIG. 4) and an upper plate part 18 (FIG. 3), which are formed from a correspondingly deformed film.

In the case presented here, this involves, for example, a film made of a thermoplastic plastic. A film made out of a suitable metal, for example, aluminum, could also be used.

As the plastic material in order to manufacture the film, ABS preferably functions, where a film in a thickness of preferably 0.30 mm is thermoformed, in order to make both plate parts 16, 18.

Figure 5:
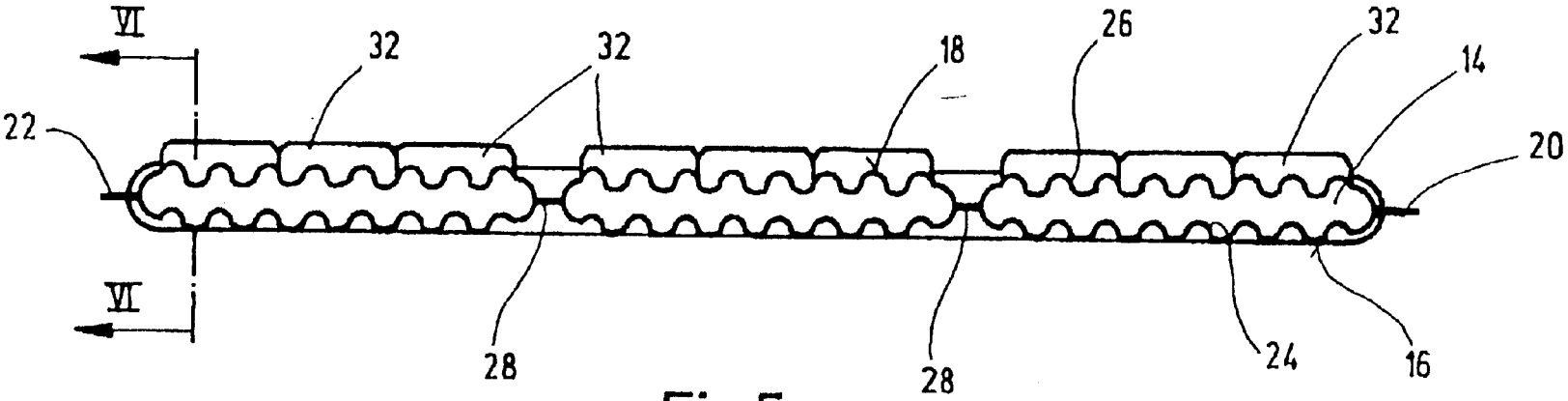
FIG. 5 is a cross-section of a heat exchanger plate made out of plate parts according to FIGS. 3 and 4.

The two plate parts 16, 18 that form a heat exchanger plate 12 depicted in FIG. 5 form molded bodies that supplement each other, so-called blisters, which are made to overlap and preferably are connected in an vapor-tight manner only along the outer longitudinal edge portions 20, 22 by fusing. Along the adjacent humid air channels 14, the channel wall portions 28 that border them to the side are preferably connected together by pressure-attachment, such that the stability of the heat exchanger plates 12 is improved.

Figure 7:
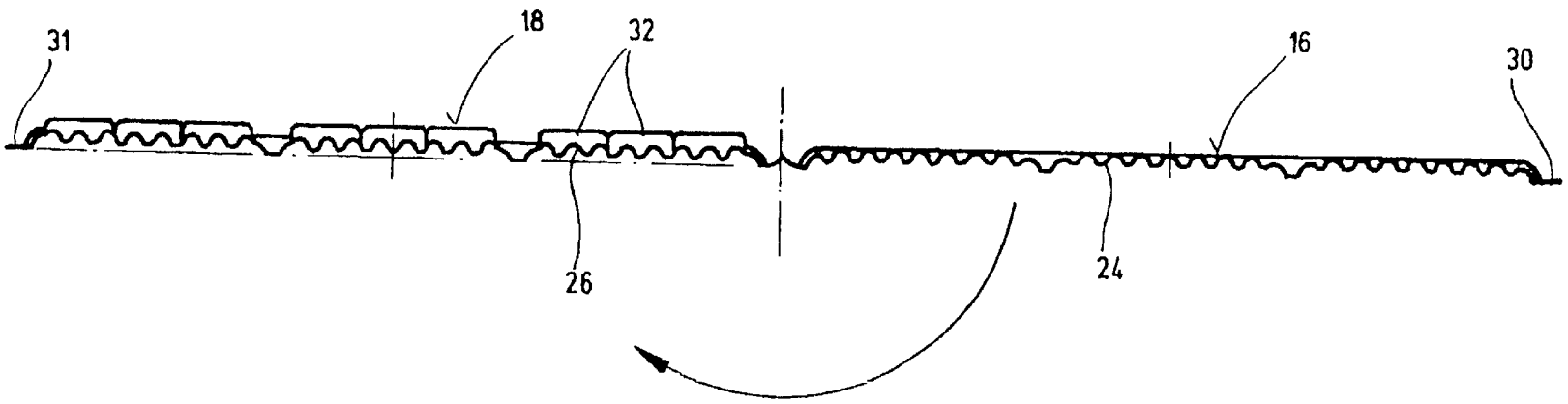
FIG. 7 is a cross section through a plastic film for the formation of a second embodiment example of a heat exchanger plate for a heat exchanger according to a first embodiment example.

As an alternative to this, the two plate parts 16 and 18, as shown in FIG. 7, can also be formed by a plastic film pre-formed as a single-piece as a blister, the halves of which are made to overlap by folding and therefore are merely further fused along two longitudinal edge parts 30 and 31 overlapping each other, for example.

The two channel wall parts 24 and 26 of the humid air channels 14 that form flat tubes are constructed so that they are corrugated perpendicularly to the flow direction of the humid air, such that both winding lines preferably run parallel to each other. This measure creates a correspondingly enlarged surface of the channel wall parts 24 and 26 that amplifies the cooling output.

Figure 3:
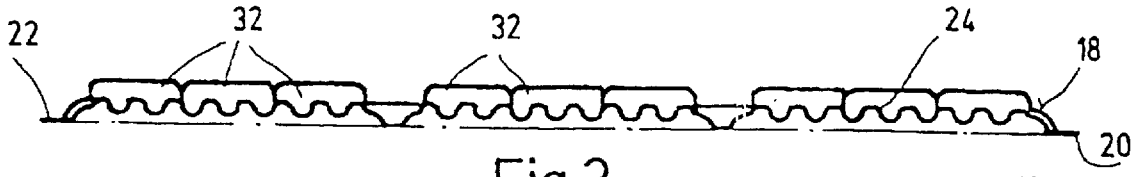
FIG. 3 is a cross-section of the upper plate part of a first embodiment example of a heat exchanger plate for a heat exchanger according to a first embodiment example.
Figure 4:
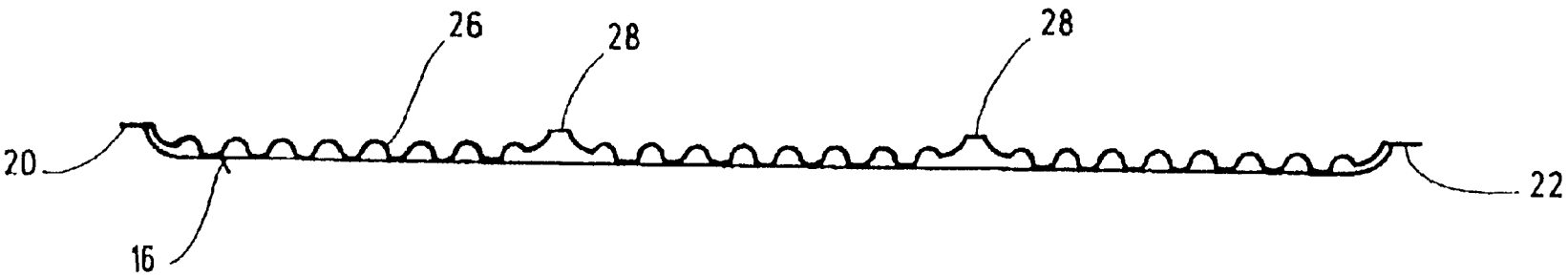
FIG. 4 is a cross-section of the lower plate part of a first embodiment example of a heat exchanger plate for a heat exchanger according to a first embodiment example.

As can be seen from FIGS. 3 and 5, cooling lamellas 32 directed vertically on the outside project from the upper plate part 18, and they extend perpendicularly to the longitudinal direction of the respective humid air channel 14. The length of these strut-like cooling lamellas 32 can correspond approximately to the width of the respective humid air channel 14.

Figure 2:
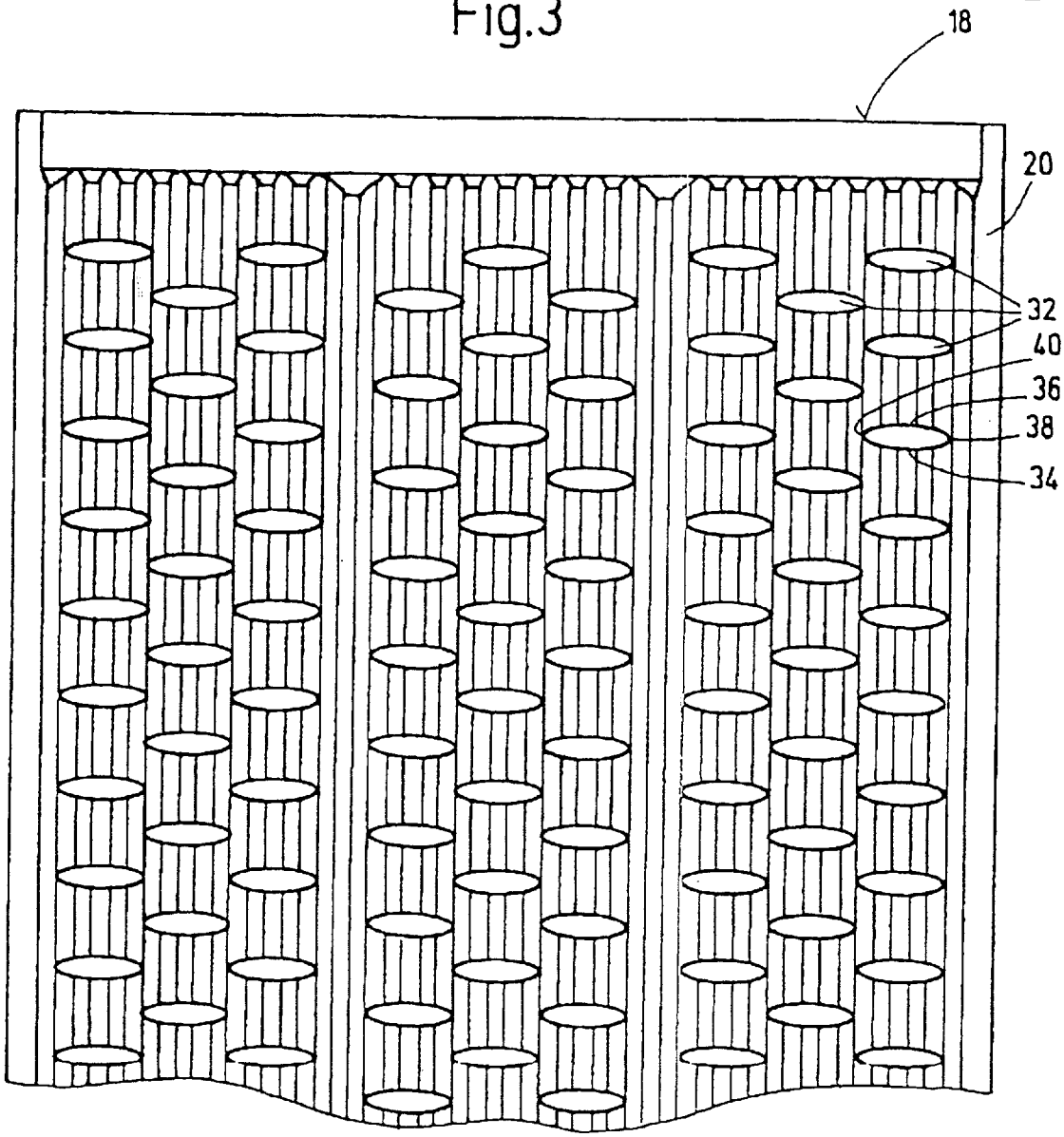
FIG. 2 is a partial top view of the heat exchanger plate stack according to FIG. 1.

In the embodiment example shown, they are, however, as can be seen especially in FIG. 2, divided over the width of each humid air channel 14 preferably into three individual lamellas 32 of the same height, which are provided offset from each other by gaps.

Figure 6:
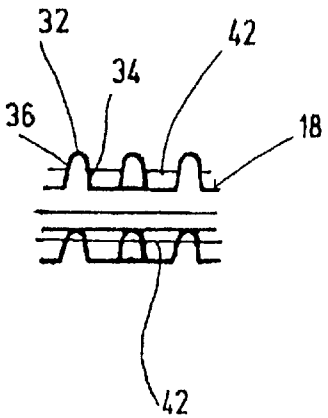
FIG. 6 is a partial longitudinal section along the line VI—VI through the heat exchanger plate according to FIG. 5.

The cooling lamellas 32 are, as shown in FIG. 6, molded by swaging in a pocket-like manner open towards the humid air channel 14, so that the longitudinal wall parts 34 and 36 of the lamella are located at a mutual distance from each other, where they are preferably constructed slightly arched to the outside in order to optimally shape the flow behavior in the cooling channels 42.

By the swaging of the cooling lamellas 32, they are provided with rounded front edges 38 and 40 (FIG. 2), which has a favorable effect by the cooling air during thecurrent flow.

When there is a corresponding dimensioning of the heat exchanger plates 12 that are corrugated in cross-section, as well as the suitable arrangement and dimensioning of the pocket-like cooling lamellas 32, a maximum dehumidification of the humid air can be obtained in the moist air channels 14.

Provided a metal film, such as aluminum film, is used, the strut-like cooling lamellas 32, as opposed to those molded from a plastic film, should have a reduced building height, in order to prevent a tearing of the metal film.

The cooling air is conducted through the heat exchanger plate stack 10 into the cooling air channels 42 that traverse the humid air channels 14 (FIG. 6). These functionally result from the fact that the heat exchanger plates 12 stacked on each other lie with their lower plate part 16 respectively on the strut-like cooling lamellas 32 of the upper plate part 18 of the heat exchanger plate 12 located beneath it (FIG. 6).

The cooling air flows around the cooling lamellas 32 and brushes over the outer surface, which runs in a wave shape, of the lower and upper plate parts 16 and 18, where the configuration of the outer surface is designed so that for a minimum structural height of the heat exchanger plate stack 10, an optimal dehumidification output, for example, 0% residual humidity, is obtained (1:1 exchanger).

Figure 8:
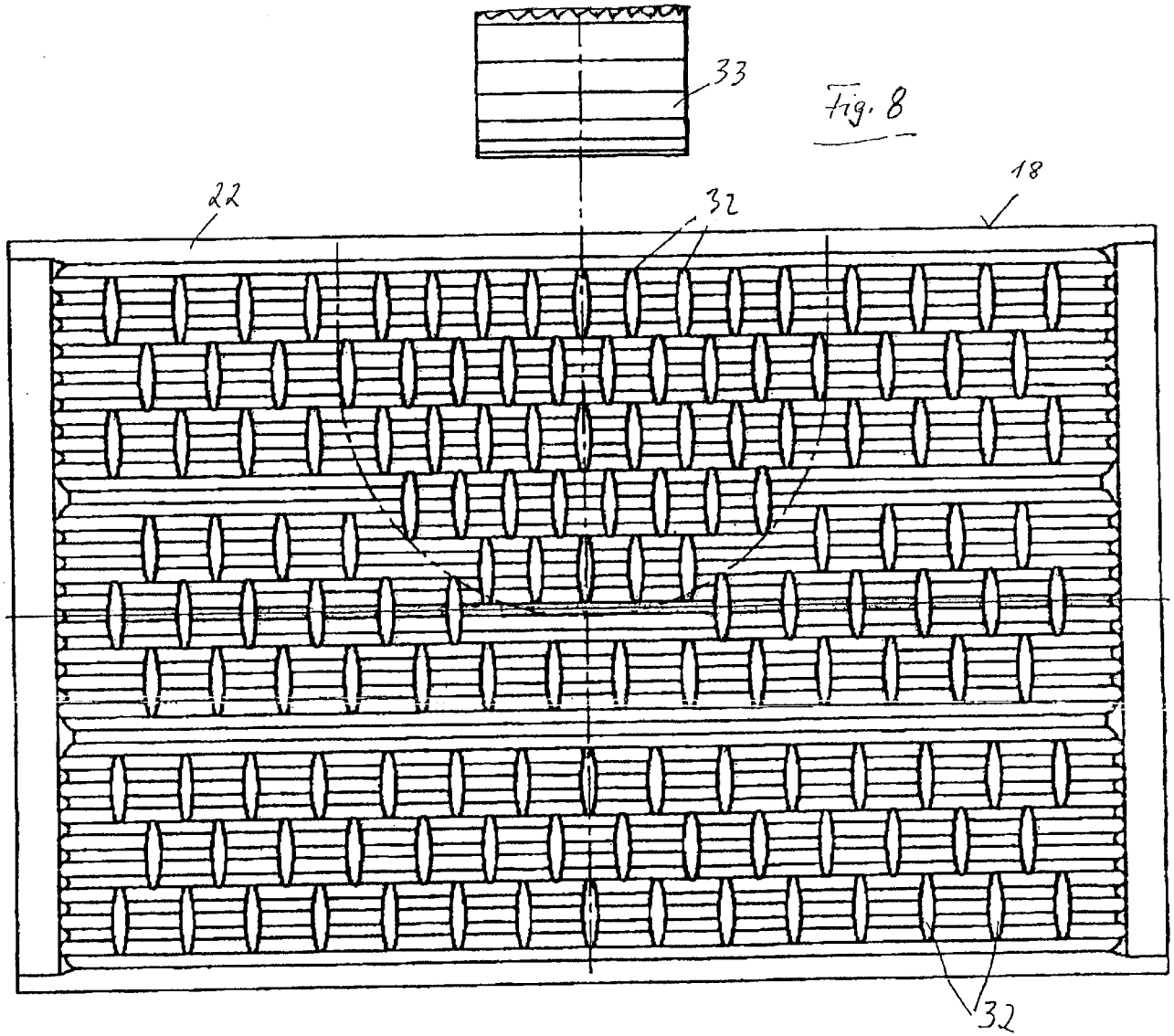
FIGS. 8 and 9 are respective views of additional embodiment examples of heat exchanger plates.
Figure 9:
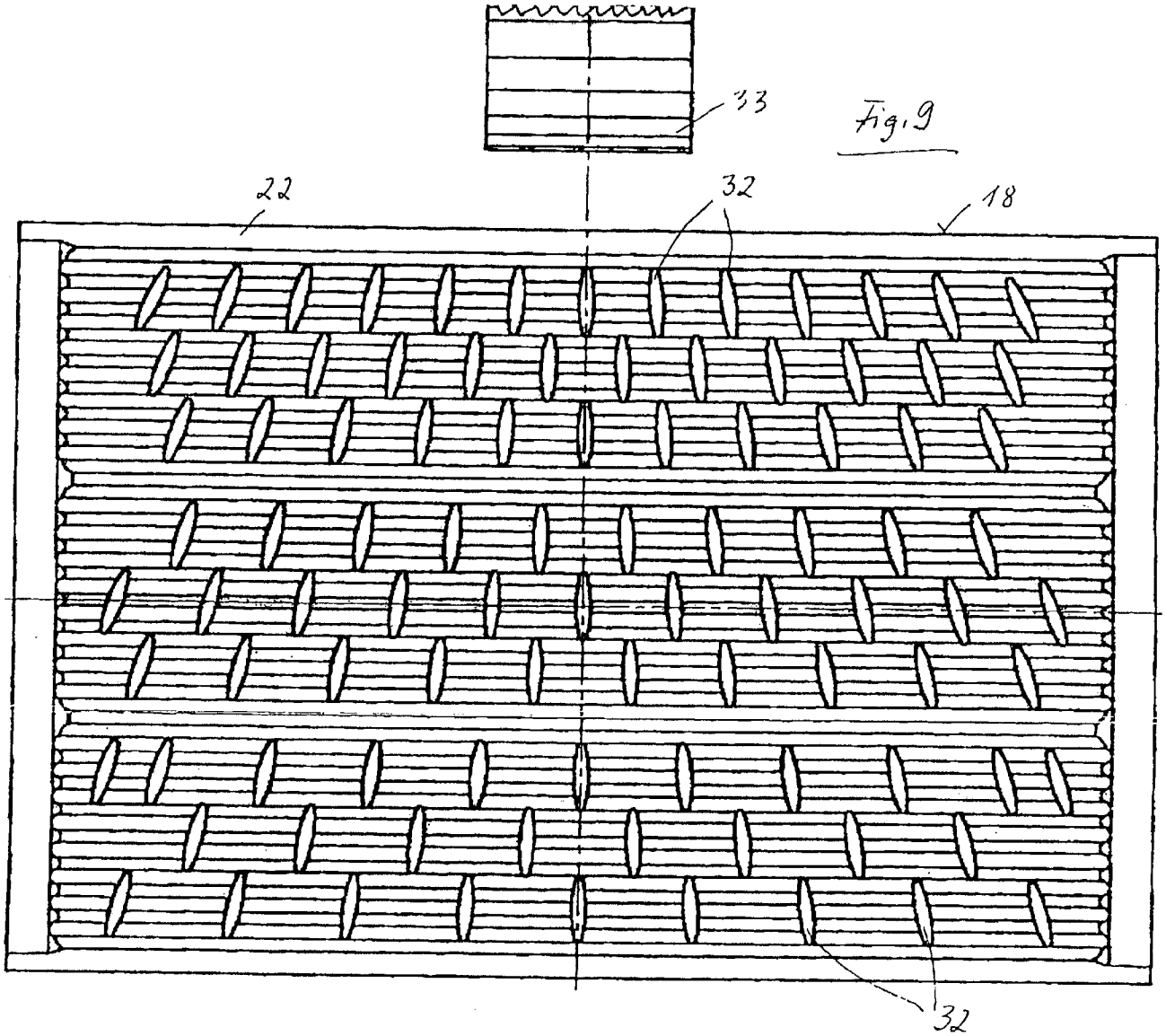

Possible variations of the arrangement of strut-like cooling lamellas 32 for the formation of a cooling air channel are depicted in FIGS. 8 and 9.

For the purpose of as uniform a distribution as possible, of an air stream flowing out of an outlet nozzle 33 of a blower mounted affixed to the machine, according to FIG. 8, for example, through an arrangement of cooling lamellas 32 compacted and facing the blower outlet nozzle 33, in the current stream region, an increase of the flow resistance can be obtained or the cooling lamellas 33 can, for this purpose, be placed at an angle, as shown in FIG. 9, e.g. symmetrically to the transverse center of the cooling air channel 42, so that the angle is further increasing at an increasing lateral distance from the channel transverse center.

By an arrangement of this type, of struts 32 or strut groups differentiated from each other, a considerable increase of the cooling output can be obtained on the cooling air side by the optimal impingement of the cooling surface. Thus, in construction-related, unfavorable installation conditions of the heat exchanger in the housing of a condensation laundry dryer, by a corresponding selection of the strut adjustment angle conducting the cooling air for the air guidance and swirling, and by the number of the struts 32 to be set at an angle, up to 20% more cooling output can be obtained in comparison to struts 32 directed in parallel.

The heat exchanger plate stack 10 is kept sealed off on its two facing sides, respectively, in a mounting frame made of plastic, as can be performed using a bonding agent, preferably casting resin.

As an alternative to this, the heat exchanger plate stack 10 can be pressed on both sides against a stamped or perforated soft rubber plate, which is inserted into the associated mounting frame.

An additional, advantageous manner of the connection of heat exchanger plate stack and mounting frame can include fusing its heat exchanger plates on each end side with a mounting frame.

In contrast to the horizontal arrangement shown in FIG. 1, of the heat exchanger plates 12, they can also be provided in an arrangement that is rotated by 90°, i.e. is vertical. In this case, onto both channel wall portions 24, 26 of the humid air channels 14, pocket-like, open struts 32 are molded. From the struts 32 then extending vertically, condensing condensate can run off on them. The increase of the cooling surface of the humid air channels 14 resulting from the two-sided strut arrangement makes possible an additional reduction of the structural height of the heat exchanger plates 12.

Figure 10:
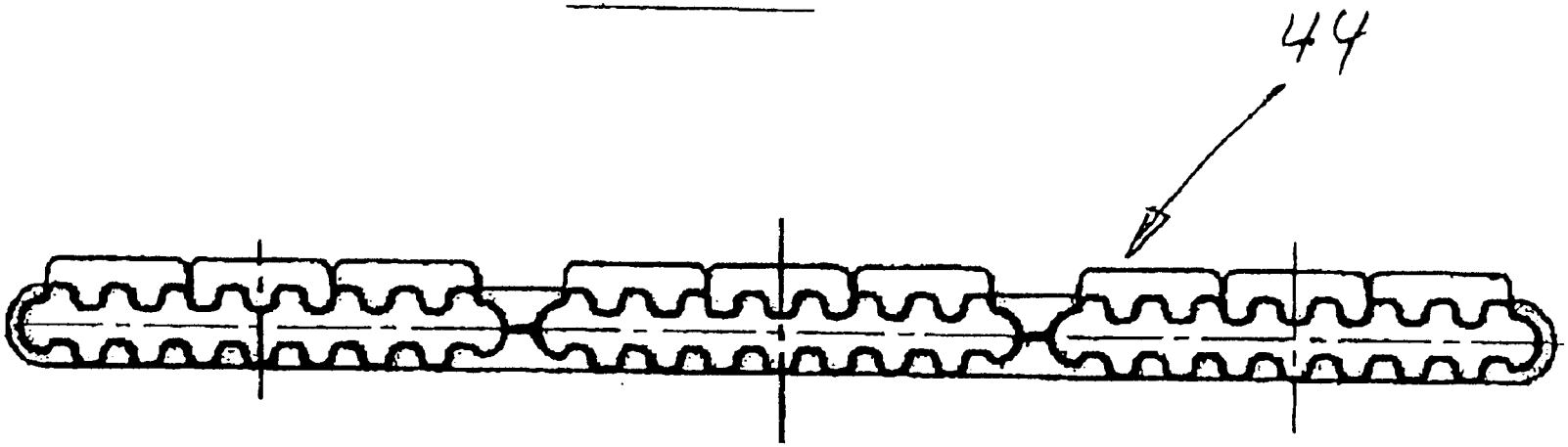
FIG. 10 is a representation similar to FIG. 5 to show the cross-section of a heat exchanger plate made by blow-molding for a heat exchanger according to a first embodiment example.
Figure 11:
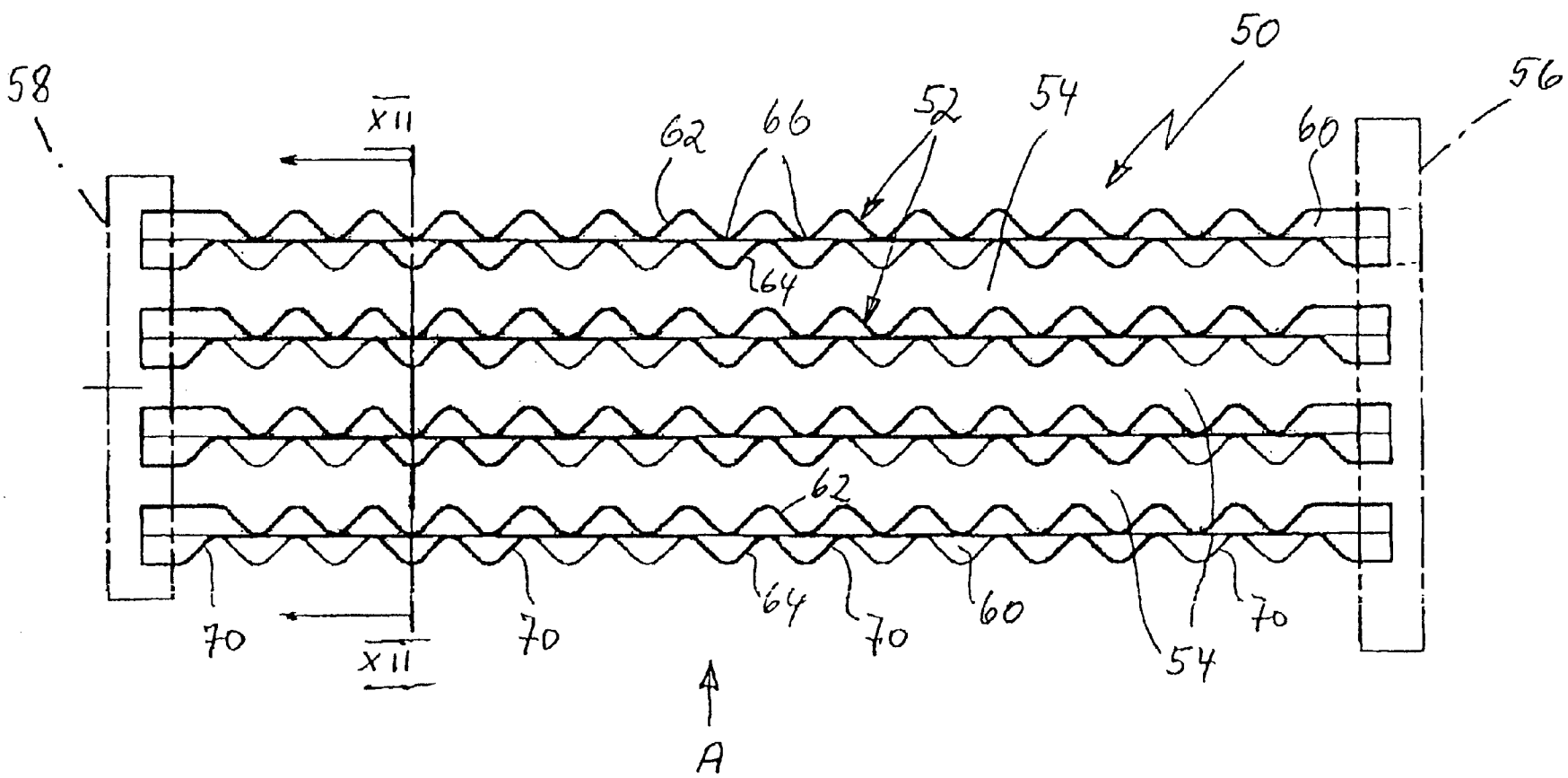
FIG. 11 is a longitudinal section through a heat exchanger stack for a heat exchanger according to an additional embodiment example.
Figure 12:
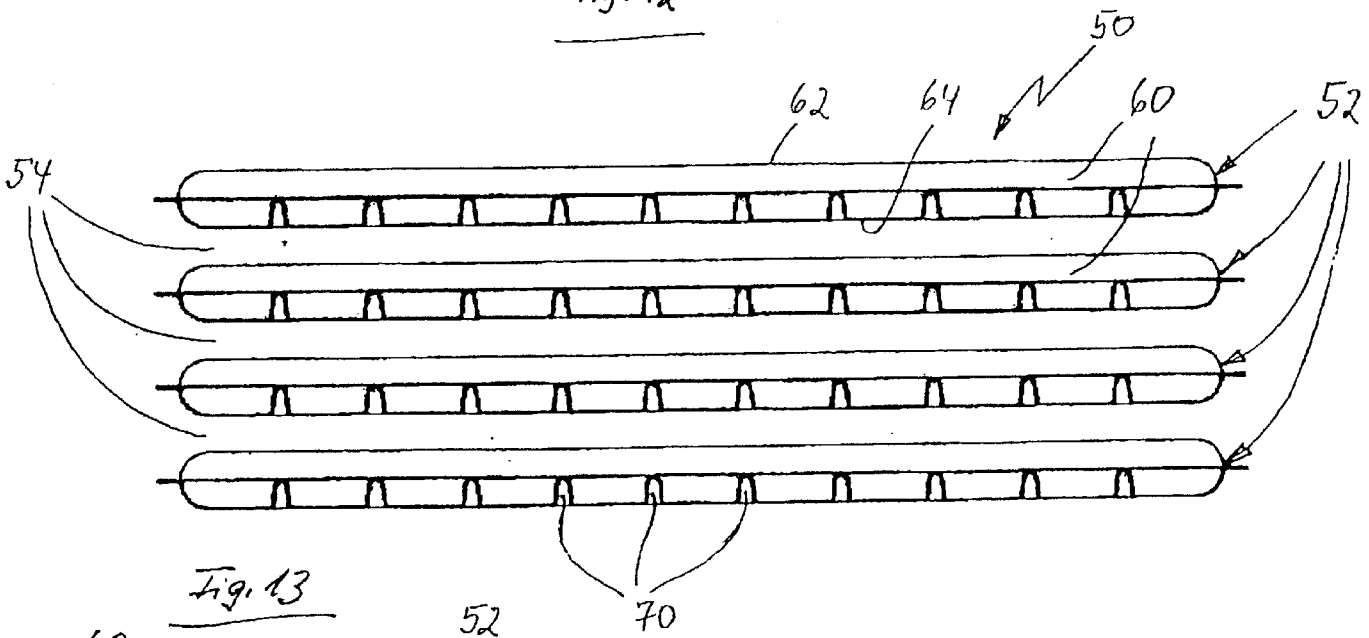
FIG. 12 is a cross section of the heat exchanger stack according to FIG. 11, seen along the sectional line XII—XII in FIG. 11.

An additional embodiment form of a heat exchanger plate according to the invention is shown in FIG. 10. In its cross-sectional design, this embodiment form essentially corresponds to the heat exchanger plates of FIG. 3 to 5, but with the difference that they are formed by shaped bodies 44 made of plastic, which is manufactured from one piece in a blow molding process, instead of by mutually connected vapor-sealed plastic films.

For this purpose, a plastic tube made in the extrusion process with a wall thickness of, for example, 0.40 mm wall thickness, is brought into ablowing mold in a thermoplastic state, squeezed off on both tube ends in this blowing mold and radially blown into the cross-sectional shape that is shown. Then, the closed tube ends are separated off from the mold body 44.

This manufacturing method allows a manufacturing process that is for the most part free from rejects.

FIG. 11 to 14 show a plate stack 50 for another embodiment of the heat exchanger. As a result thereof, the cooling air is guided through its heat exchanger plates 52, while the humid air flows through humid air channels 54, which are present between the heat exchanger plates 52.

The heat exchanger plates 52 are held sealed off by the facing ends each in a mounting frame 56 or 58, indicated by dot-dashed lines, which they pass through with their cooling air channel 60.

The upper plate part 62 and lower plate part 64 of the heat exchanger plates 52 are preferably constructed corrugated in parallel in the flow direction of the cooling air, such that a correspondingly increased cooling surface is obtained.

The corrugated profile is preferably selected in such a manner, that the base 66 of the wave troughs are located approximately at the half height of the cooling air channels 60 (see FIG. 13), such that a correspondingly large impingement of the corrugated channel inner surfaces is ensured for effective heat diversion.

The wave profile can also run asymmetrically as seen perpendicularly to the flow direction of the cooling air, i.e. the build-up phase flatter in the flow direction and the fall-off phase steeper. In this way, the pressure loss can be reduced and flow separations can for the most part be prevented on the fall-off side.

Figure 13:
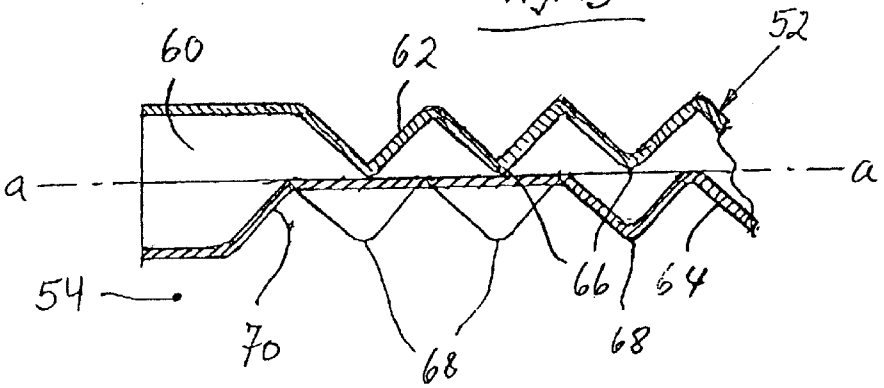
FIG. 13 is a section of FIG. 11, in a scale that is enlarged relative to that Figure.
Figure 14:
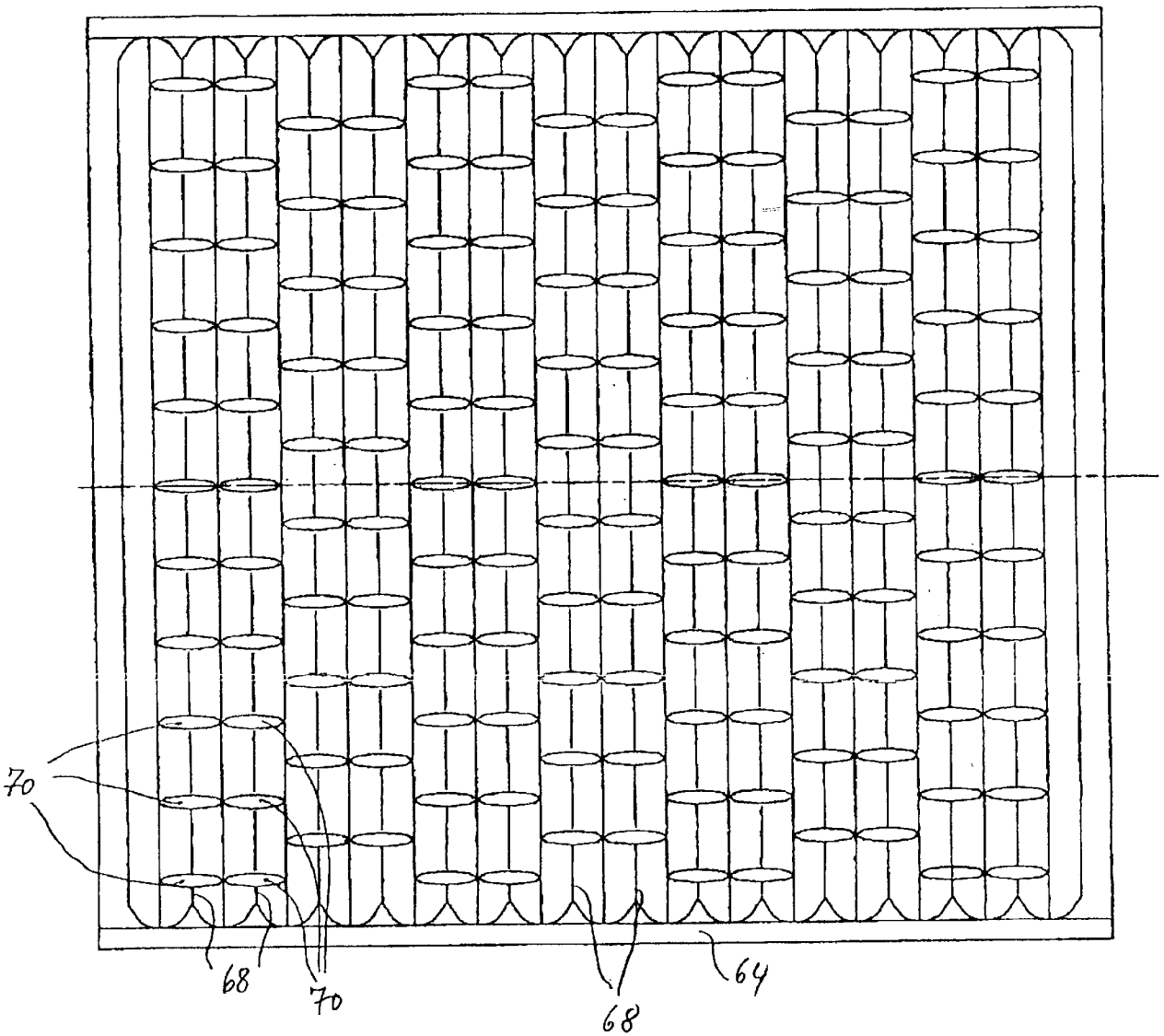
FIG. 14 is a view of the heat exchanger stack.

As can be seen from FIGS. 13 and 14, several longitudinal recesses 70, each set off from each other to the side, are molded into the wave crests 68 of the lower plate part 64 of the heat exchanger plates 52. These recesses extend perpendicularly to the longitudinal direction of the wave crests 68 and up into the partition plane a-a of the heat exchanger plates 52, and form the pockets open towards the humid air channel 54 located below. Preferably in the process, two recesses 70 at a time are provided in alignment with each other in adjacent wave crests 68, such that according to FIG. 13 relatively long spacers come into being, on which the wave troughs of the upper plate part 62 are supported by their base 66.

The spacers formed by the recesses 70 thus contribute to a stabilization and reinforcement of the plate parts 62 and 64, vertically to the flow direction of the cooling air conducted in their channel 60. The plate parts 62 and 64 are preferably made of a thin-walled plastic film according to FIG. 13, and furthermore, form, in the inside of the channel, cooling elements extending in the flow direction.

In a manner similar to the heat exchanger plates 12 of FIG. 1 to 10, the plate parts 62 and 64 can be molded or manufactured by blow molding.

What is claimed is:

1. A heat exchanger for condensation laundry dryers, having several flat heat exchanger plates (12) which are layered in parallel to each other at separation distances as a stack (10), where each plate contains at least one humid air channel (14) and is made out of a film, the humid air channel having a humid air inlet and a humid air outlet to permit a humid air flow along the humid air channel from the humid air inlet to the humid air outlet, said heat exchanger plates having several struts (32) functioning as cooling lamellas which project out from said heat exchanger plates, said struts being elongated perpendicular to the humid air channel (14) and, supported together on an adjacent heat exchanger plate (12), form cooling air channels (42), the cooling air channels having a cooling air inlet and a cooling air outlet to permit a cooling air flow along the cooling air channels from the cooling air inlet to the cooling air outlet, the cooling air channels extending perpendicular to the humid air channel so that the cooling air flow is perpendicular to the humid air flow, the struts being elongated in a direction perpendicular to the humid air flow and parallel to the cooling air flow, where the heat exchanger plates (12) are fixed on their facing ends that have the openings of the humid air channel (14) so that they are sealed off from each other in a mounting frame, wherein the struts (32) that form the cooling lamellas are shaped as pockets that open towards the humid air channel (14), and wherein adjacent humid air channels (14) are pressure attached together with connecting connection struts (28).

2. The heat exchanger according to claim 1, wherein said film is made of one of a thermoplastic plastic and a heat-conducting metal.

3. The heat exchanger according to claim 1, wherein the at least one humid air channel (14) is formed by a flat tube and the struts (32) are molded onto at least one flat tube wall part (26) forming the flat tube.

4. A heat exchanger for condensation laundry dryers, having several flat heat exchanger plates (12) which are layered in parallel to each other at separation distances as a stack (10), where each plate contains at least one humid air channel (14) and is made out of a film, the humid air channel having a humid air inlet and a humid air outlet to permit a humid air flow along the humid air channel from the humid air inlet to the humid air outlet, said heat exchanger plates having several struts (32) functioning as cooling lamellas which project out from said heat exchanger plates, said struts being elongated perpendicular to the humid air channel (14) and, supported together on an adjacent heat exchanger plate (12), form cooling air channels (42), the cooling air channels having a cooling air inlet and a cooling air outlet to permit a cooling air flow along the cooling air channels from the cooling air inlet to the cooling air outlet, the cooling air channels extending perpendicular to the humid air channel so that the cooling air flow is perpendicular to the humid air flow, the struts being elongated in a direction perpendicular to the humid air flow and parallel to the cooling air flow, where the heat exchanger plates (12) are fixed on their facing ends that have the openings of the humid air channel (14) so that they are sealed off from each other in a mounting frame, wherein the struts (32) that form the cooling lamellas are shaped as pockets that open towards the humid air channel (14), wherein the at least one humid air channel (14) is formed by a flat tube and the struts (32) are molded onto at least one flat tube wall part (26) forming the flat tube, and wherein a length of the struts (32) molded onto the one flat tube wall part (26) forming the flat tube only amounts to a fraction of a width of the flat tube and the struts (32) are arranged to be offset from each other by gaps in the longitudinal direction of the humid air channel (14).

5. The heat exchanger according to claim 3, wherein the struts (32) are formed in a slightly convex manner to the outside of the flat tube with elongated sides of the struts disposed perpendicular to a flow direction of humid air through the humid air channel (14).

6. The heat exchanger according to claim 3, wherein the struts (32) are oriented on the flat tube wall part at least over a surface area of it, at an angle to the current flow direction of the cooling air.

7. The heat exchanger according claim 3, wherein the struts (32) are provided in a compacted arrangement, at least in certain areas, on the flat tube wall part at an inlet end of the cooling air channel of the heat exchanger plates (12).

8. The heat exchanger according to claim 6, wherein the struts (32) oriented at an angle over the entire flat tube wall part in the current stream direction of the cooling air, are ordered in a symmetrical arrangement to each other.

9. The heat exchanger according to claim 1, wherein the heat exchanger plates (12; 52) each made out of two plate edge parts arranged congruently and lying on top of each other, are connected in an air-tight manner with each other, and include plate parts (16, 18; 62, 64) that are formed from plastic films.

10. The heat exchanger according to claim 9, wherein the plastic films that form the two plate parts (16, 18; 62, 64) are a single piece and are made to overlap each other by folding and are bonded together along the two longitudinal edge portions that cover each other by fusing, adhering, or pressure-attaching.

11. The heat exchanger according to claim 10, wherein the two halves (16, 18; 62, 64) of the plastic film that each form one of the flat tube wall parts (24 or 26) are shaped along their foldable connection piece in a groove-like manner in such a way that for the halves of the plastic film of this connection piece, which are made to overlap, a longitudinal edge piece of the flat tube, which is U-shaped in cross-section, is formed.

12. The heat exchanger according to claim 1, wherein the heat exchanger plates (12; 52) are formed as a blow molded part of plastic.

13. The heat exchanger according to claim 1, wherein the film is made of a plastic from the group of acrylonitrile-butadiene-styrene coplymers (ABS) and polypropylene.

14. The heat exchanger according to claim 13, wherein the film for the construction of the heat exchanger plates (12, 52) has a film thickness of between 0.15 mm and 0.50 mm.

15. The heat exchanger according to claim 1, wherein the plate parts (16, 18; 62, 64) are made of metal film with a thickness of between 0.14 mm and 0.20 mm.

16. The heat exchanger according to claim 15, wherein the plate parts (16, 18; 62, 64) of the heat exchanger plates (12; 52), consist of aluminum film, and are connected to each other in an air-tight manner along two edge parts lying opposite each other.

17. The heat exchanger according to claim 1, wherein the heat exchanger plates (12; 52) are arranged horizontally.

18. The heat exchanger according to claim 1, wherein the heat exchanger plates (12; 52) are arranged vertically.

19. The heat exchanger according to claim 14, wherein said wall or film thickness is approximately 0.30 mm.

20. The heat exchanger according to claim 15, wherein the metal film has a thickness of approximately 0.15 mm.

21. The heat exchanger according to claim 15, wherein the metal film is aluminum.

22. A heat exchanger for condensation laundry dryers, having several flat heat exchanger plates (12) which are layered in parallel to each other at separation distances as a stack (10), where each plate contains at least one humid air channel (14) and is made out of a film, said heat exchanger plates having several struts (32) functioning as cooling lamellas which project out from said heat exchanger plates, said struts being elongated to extend perpendicular to the humid air channel (14) and, supported together on an adjacent heat exchanger plate (12), form cooling air channels (42), where the heat exchanger plates (12) are fixed on their facing ends that have the openings of the humid air channel (14) so that they are sealed off from each other in a mounting frame, wherein the struts (32) that form the cooling lamellas are shaped as pockets that open towards the humid air channel (14), wherein adjacent struts overlap one another in a cooling-air-channel direction to extend completely across the humid air channel.

* * * * *